United States Patent [19]

Walgrove

[11] Patent Number: 4,910,400

[45] Date of Patent: Mar. 20, 1990

[54] PROGRAMMABLE FOCUSSED CORONA CHARGER

[75] Inventor: George R. Walgrove, Rochester, N.Y.

[73] Assignee: Eastman Kodak Company, Rochester, N.Y.

[21] Appl. No.: 111,947

[22] Filed: Oct. 23, 1987

[51] Int. Cl.[4] ..... H01T 19/00

[52] U.S. Cl. ..... 250/324; 250/326

[58] Field of Search ..... 250/324, 325, 326; 346/159; 361/229, 230

[56] References Cited

U.S. PATENT DOCUMENTS

| | | | |
|---|---|---|---|
| 2,701,764 | 2/1955 | Carlson . | |
| 3,390,266 | 6/1968 | Epping . | |
| 3,660,656 | 5/1972 | Frank et al. . | |
| 3,937,960 | 2/1976 | Matsumoto et al. | 250/324 |
| 4,053,770 | 10/1977 | Tanaka et al. . | |
| 4,088,892 | 5/1978 | Plumadore . | |
| 4,100,411 | 7/1978 | Davis | 250/324 |
| 4,110,614 | 8/1978 | Sarid et al. | 250/324 |
| 4,564,282 | 1/1986 | Shenoy . | |
| 4,574,326 | 3/1986 | Myochin et al. . | |
| 4,591,713 | 5/1986 | Gundlach . | |
| 4,656,356 | 4/1987 | Yoda et al. . | |

*Primary Examiner*—Bruce C. Anderson
*Attorney, Agent, or Firm*—Milton S. Sales

[57] ABSTRACT

A corona charger can be programmed without physical adjustment to the charger, to give a plurality of desired characteristic plate current-to-potential curves so that one charger design can be used for a number of different charger formulations. The corona charger includes a conductive electrode and a corona wire between the electrode and the receiver. A variable duty cycle, pulsing voltage is applied to the electrode of same sign as the voltage applied to the corona wire, such that the corona charge produced by the wire is periodically accelerated by the electrode to the receiver.

5 Claims, 2 Drawing Sheets

PROGRAMMABLE FOCUSSED CORONA CHARGER

CROSS-REFERENCE TO RELATED APPLICATION

Reference is made to commonly assigned, co-pending U.S. Pat. Application Ser. No. 104,469 filed Oct. 5, 1987 in the name of G. R. Walgrove, now Pat. No. 4,775,915 issued Oct. 4, 1988.

BACKGROUND OF THE INVENTION

1. Field of the Invention

This invention relates generally to corona charging, and more particularly to an improved corona charger which is adaptable for a plurality of uses without physical adjustment to the charger. The charger is particularly suitable for electrostatographic machines.

2. Description of the Prior Art

Referring to FIG. 1, conventional corona charger designs for electrostatographic applications generally utilize a thin wire 10 surrounded by a grounded metal shell 12. Corona wire 10 is typically driven at a D.C. potential of say −5.4kV, which results in a characteristic plate current-to-potential curve such as shown in FIG. 2.

Although the charger design of FIG. 1 is adequate for transfer purposes, its performance is not optimum since it is voltage sensitive and does not act as a constant-current device. Accordingly, a charger set up to deliver the correct amount of charge for a receiver of one conductivity would not deliver the correct amount of charge if the receiver's conductivity changed because the charger is voltage sensitive.

Another problem with conventional chargers is that, due to the cutoff potential of the charger, they are not able to deliver sufficient charge under dry conditions. As the receiver potential approaches this cut-off, the wire potential, corona output is suppressed and current output to the receiver goes to zero. This could be overcome just by increasing the wire potential, but current output would then get excessively high, and high potentials result in overcharging in more humid conditions.

The problems mentioned above can be minimized by a focused corona charger such as the transfer station charger disclosed in commonly assigned, co-pending U.S. Pat. Application Ser. No. 104,469 filed Oct. 5, 1987 in the name of G. R. Walgrove, now Pat. No. 4,775,915 issued Oct. 4, 1988 which charger operates in a mode that better approximates constant-current operation and which reduces the transfer time. That focussed corona charger has a periodically energized corona wire and a non-conductive shell about the wire open towards a receiver surface. A conductive electrode is situated on the side of the wire opposed to the receiver. A voltage is applied to the wire and, with a time lag, to the electrode so that a useful amount of charge is generated by the wire before being accelerated to the receiver by the electrode when the voltage on the electrode approximates the voltage on the wire. A typical focussed charger characteristic plate current-to-potential curve in accordance with the charger disclosed in aforesaid U.S. Pat. Application Ser. No. 104,469 is shown in Figure 3. The characteristic curve shows a high cutoff (the point at which the curve intersects the x-axis) and a low slope. For the transfer operation, this is ideal, as it provide constant-current operation and minimizes sensitivity to receiver characteristics.

However, the transfer operation is not the only electrostatographic machine application for a corona charger. Chargers are also used for photoconductor charging, sheet detacking, photoconductor conditioning, etc. Each operation requires different operating characteristics from the charging device. That is, a different current-to-potential curve. It would be advantageous if the focussed charger could be used for all charging functions without physical adjustment to the charger.

Conventional corona charging techniques do not, however, allow programmability. The slope and cutoff of the chargers' characteristic plate current-to-potential curves can not be adjusted independently. Any attempt to adjust the cutoff by, for example, increasing the wire potential, results in a corresponding increase in the slope of the curve. To overcome this, typically a compromise is made where acceptable but not optimum charger performance is obtained. Often, physical adjustment of the charger with respect to the surface being charged is required to achieve even adequate performance. This increases the system cost and an adjustable charger mount is required.

SUMMARY OF THE INVENTION

It is an object of the present invention to provide a corona charger which can be programmed without physical adjustment to the charger, to give a plurality of desired characteristic plate current-to-potential curves so that one charger design can be used for a number of different charger formulations.

According to the present invention, a corona charger includes a conductive electrode and a corona wire between the electrode and the receiver. A pulsing voltage is applied to the electrode of same sign as the voltage applied to the corona wire, such that the corona charge produced by the wire is periodically accelerated by the electrode to the receiver.

In a preferred embodiment of the present invention includes a non-conductive shell about the corona wire, the shell being open toward the receiver such that the corona charge is directed toward the receiver. Preferably, the electrode is within said shell. The pulsing the voltage applied to the electrode preferably has a variable duty cycle.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE PREFERRED EMBODIMENTS

Figure 1:
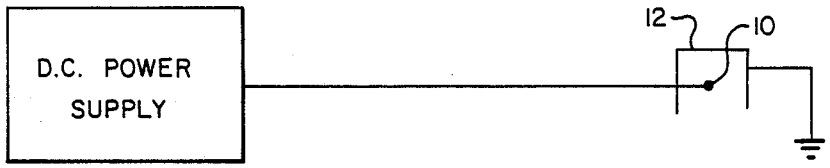
PRIOR ART FIG. 1
FIG. 1 is a schematic view of a corona charger system known in the prior art.
Figure 2:
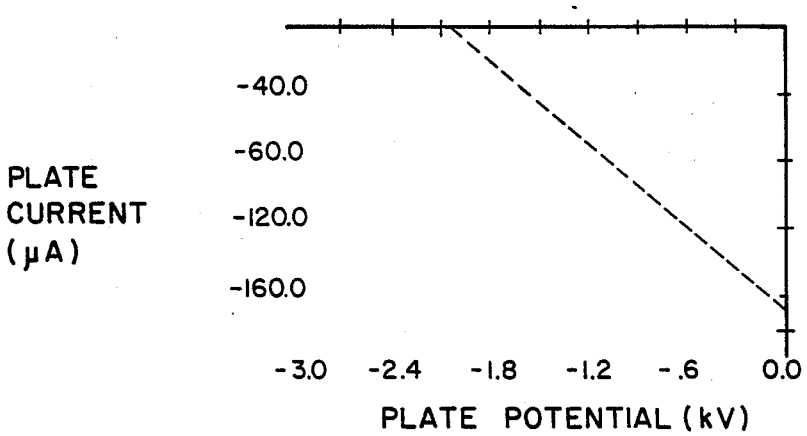
FIG. 2 is a plot of characteristic plate current-to-potential of the system of FIG. 1.
Figure 3:
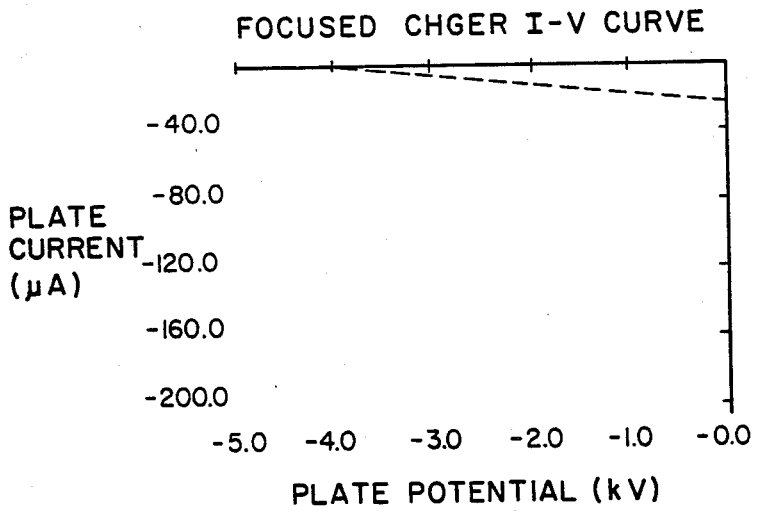
FIG. 3 is a plot of characteristic plate current-to-potential of a focussed charger.
Figure 4:
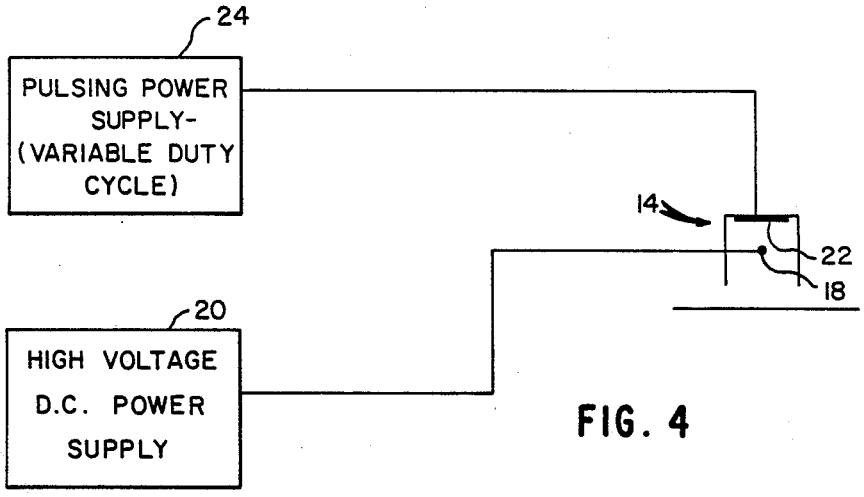
FIG. 4 is a schematic view of a programmable focussed configuration in accordance with a preferred embodiment of the present invention.

A focussed charger 14 is illustrated in FIG. 4, and includes a non-conductive shell 16 and a corona wire 18 positioned within the shell. A three mill diameter wire as conventionally used in existing charger designs is satisfactory.

Figure 5:
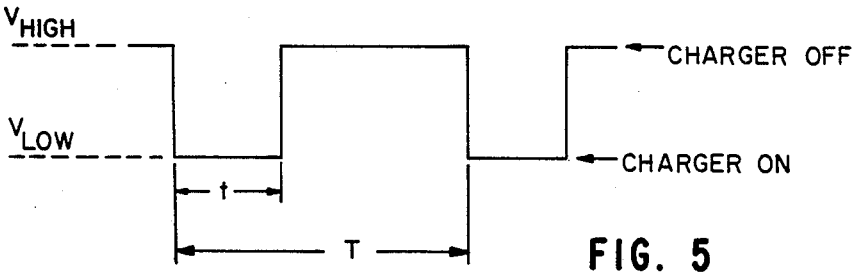

A high voltage DC power supply 20 excites corona wire 18, creating a cloud of corona charge around the wire. An electrode such as a plate 22 is biased by a pulsating power supply 24 which has an adjustable duty cycle. Pulsing power supply 24 oscillates the potential of electrode plate 22 between two voltage levels, as shown in FIG. 5. At the low voltage level, the corona generates charge which is accelerated by back bias plate 22 to the surface being charged. At the high voltage level, the plate bias shuts down the corona, even though the potential on corona wire 18 has not changed. In other words, the corona current can be turned on and off simply by varying the back plate potential.

The pulse period is represented in FIG. 5 by time "T" and the duration that the charger is on during each period is represented by time "t." The duty cycle is the percentage of time that the charger is on, and is calculated as follows:

$$\text{Duty Cycle} = (100)\ t/T$$

By varying the duty cycle of the pulsed waveform, and thereby and on/off time of corona charger 14, the back plate is used essentially as a high voltage switch. The current output of the charger can thereby be varied without affecting the cutoff potential; allowing the charger output to be programmed, and resulting in independent control over the characteristic plate current-to-potential curve cutoff and slope.

The invention has been described in detail with particular reference to preferred embodiments thereof, but it will be understood that variations and modifications can be effected within the spirit and scope of the invention.

What is claimed is:

1. A corona charger for charging a receiver, said charger comprising:

a conductive electrode;

a corona wire between said electrode and the receiver;

means for applying a voltage to said wire, whereby a corona charge is produced; and means for applying to said electrode a voltage of same sign as the voltage applied to said wire, said applied voltage pulsing between a low level such that the corona charge is accelerated by the electrode to the receiver and a high level such that the corona shuts down.

2. A corona charger as set forth in claim 1 further comprising a non-conductive shell about said wire, said shell being open toward the receiver such that the corona charge is directed toward the receiver

3. A corona charger as set forth in claim 2 wherein said electrode is within said shell.

4. A corona charger as set forth in claim 1 wherein said means for pulsing the voltage to said electrode is a variable duty cycle, pulsing power supply.

5. A corona charger as set forth in claim 4 wherein said means for applying a voltage to said wire is a high voltage DC power supply.

* * * * *